US009233447B2

(12) United States Patent
Shortridge, Sr.

(10) Patent No.: US 9,233,447 B2
(45) Date of Patent: Jan. 12, 2016

(54) STAVE HONE ASSEMBLY FOR USE WITH ROTATING SHAFTS

(71) Applicant: Robert Alan Shortridge, Sr., Powhatan, VA (US)

(72) Inventor: Robert Alan Shortridge, Sr., Powhatan, VA (US)

( * ) Notice: Subject to any disclaimer, the term of this patent is extended or adjusted under 35 U.S.C. 154(b) by 0 days.

(21) Appl. No.: 14/274,826

(22) Filed: May 12, 2014

(65) Prior Publication Data

US 2015/0321310 A1 Nov. 12, 2015

(51) Int. Cl.
*B24B 5/37* (2006.01)
*B24B 33/08* (2006.01)
*B24B 33/04* (2006.01)

(52) U.S. Cl.
CPC ..... *B24B 33/086* (2013.01); *B24B 33/04* (2013.01); *B24B 33/081* (2013.01)

(58) Field of Classification Search
CPC ..... B24B 5/363; B24B 5/37; B24B 33/086; B24B 33/04; B24B 33/081
USPC ..... 451/49, 439, 428
See application file for complete search history.

(56) References Cited

U.S. PATENT DOCUMENTS

| | | | | |
|---|---|---|---|---|
| 675,590 | A * | 6/1901 | Darrall | 451/428 |
| 1,742,256 | A | 1/1930 | Jessop | |
| 2,167,311 | A * | 7/1939 | Postma | 451/49 |
| 2,245,820 | A * | 6/1941 | Postma | 451/482 |
| 2,409,267 | A | 10/1946 | Gatke | |
| 3,632,120 | A | 1/1972 | Brandt | |
| 4,149,761 | A | 4/1979 | Telle | |
| 5,372,430 | A | 12/1994 | Orndorff, Jr. et al. | |
| 6,113,471 | A * | 9/2000 | Kuebler | 451/49 |
| 7,290,932 | B2 | 11/2007 | Orndorff, Jr. | |

* cited by examiner

*Primary Examiner* — Robert Rose
(74) *Attorney, Agent, or Firm* — Thomas, Karceski & Karmilovich, P.C.

(57) ABSTRACT

A hone insert is adapted for use in a rotating shaft system that has a segmented stave bearing housing. The stave bearing housing includes multiple stave bearing inserts that retain the rotating shaft. The hone insert is supported by a mounting bar section and a support pad that bears a hone layer against the face of the rotating shaft. Accordingly, as the shaft rotates against the hone layer, the surface of the shaft is made more smooth.

6 Claims, 8 Drawing Sheets

STAVE HONE ASSEMBLY FOR USE WITH ROTATING SHAFTS

The present invention, relates to the repair and smoothing of rotating shafts and their shaft sleeves in place in a stave bearing assembly. A stave bearing insert portion of the bearing assembly is removed or substituted with a repair hone insert or series of inserts.

BACKGROUND

In conventional shaft systems, cylindrical bearing sleeves may be mounted around rotating shafts. A bearing housing surrounds the shaft and bearing sleeve and has several bar shaped, substantially trapezoidal cross-section cavities in which stave bearing inserts are installed. The bearing surfaces of the stave bearing inserts bear upon the rotating shaft sleeve and thereby hold the rotating shaft in a fixed position against sideways movement.

Stave bearing inserts are made of materials that perform best when they are in contact with a smooth cylindrical sleeve. If the bearing sleeve surfaces wear unevenly, the sleeves must be repaired and machined to having a smooth cylinder surface. When the sleeve wall gets too thin it must simply be replaced.

Shaft sleeves can be machined in place to polish and repair their surface if enough clearance is available to fit a portable machining device. The process involves dismantling the entire bearing assembly, installing the portable machining device, and then removing enough material from the sleeve to make a clean and smooth cylindrical surface. New bearing inserts are then machined to fit the new sleeve diameter. Alternatively, the entire shaft can be removed and transported to a machining facility to have the sleeve machined or replaced. This is a major expense and typically involves months of downtime, and major outage losses.

As stave bearing inserts wear out, they often cut circular grooves around the bearing sleeve and scratch the sleeve surface. The unit is then taken out of service awaiting repair for an indefinite period and corrosion and other buildup on the sleeve surface occurs.

If instead scratches, corrosion and other buildup on the shaft sleeves can be smoothed out in place, new stave inserts can be installed which will perform well for years bearing only the high spots between the circular grooves on the sleeve. It is not feasible to clean and polish the sleeves by hand and achieve a satisfactory result.

SUMMARY

Accordingly, it is an object of the present invention to provide a hone insert that is adapted for use in a rotating shaft system. The hone insert may be used to smooth the surface of a rotating shaft in place so that the shaft will rotate more efficiently within the bearing housing.

In one example, a hone insert is adapted for use in a rotating shaft system having a segmented stave bearing housing comprised of a plurality of stave bearing inserts to retain the rotating shaft. The hone insert includes a mounting bar section adapted to removably fit into a stave bearing cavity in a segmented stave bearing housing. The mounting bar section has a longitudinal bearing side adapted to face a rotating shaft mounted in the stave bearing housing. The mounting bar section is comprised of a rigid material. A support pad is attached to the longitudinal bearing side of the mounting bar section, wherein the support pad comprises a hone layer on the side of the support pad opposite the mounting bar section and adapted to be adjacent the rotating shaft when mounted in the stave bearing housing. The hone layer comprises an abrasive material on the face thereof adapted to bear against the surface of the rotating shaft. The hone insert may include a support pad that is comprised of a flexible foam material, or alternatively it may comprise a bladder therein along the longitudinal length of the support pad. The bladder may be adapted to be inflated pneumatically with air, or alternatively hydraulically with a liquid. The support pad may be releasably attached to the mounting bar section, or alternatively fixedly attached to the mounting bar section. The hone layer may be attached to the support pad along the side of the support pad adapted to be adjacent the rotating shaft, or alternatively the hone layer may be integral in the side of the support pad adapted to be adjacent the rotating shaft.

DETAILED DESCRIPTION

The hone insert and the method of using the hone insert as described herein provide for the smoothing of the surface of a rotating shaft, or alternatively the bearing sleeve mounted on the rotating shaft while the shaft is in place. In one particular example of the hone insert that will be described herein, the rotating shaft is a large shaft that may be used in the power generation industry. The hone insert allows that shaft, or its sleeve, to be smoothed in place rather than going to the significant and expensive alternative of removing the shaft for repair and smoothing. Of course the hone insert may have uses with other rotating shafts for smoothing or otherwise repairing the surface of that rotating shaft in place.

Figure 1:
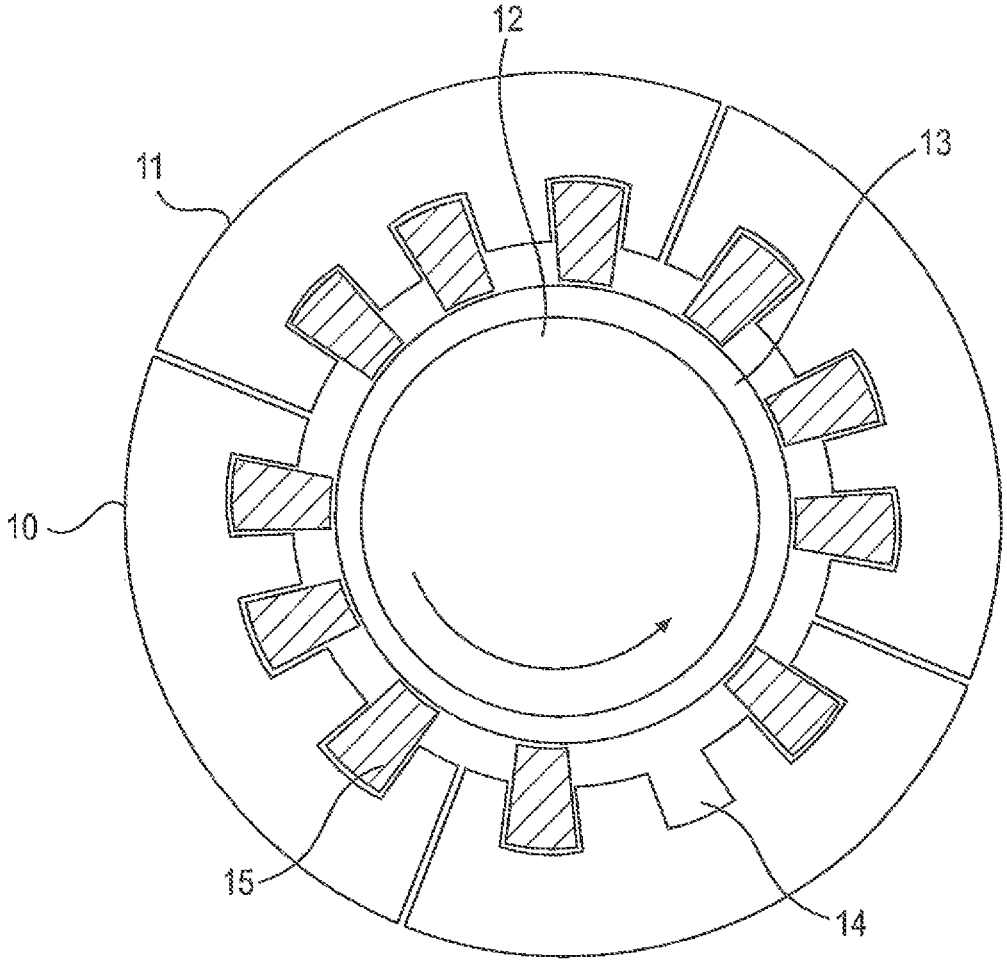
FIG. 1 is a top plan view of a segmented stave bearing housing and a shaft rotating therein.
Figure 2:
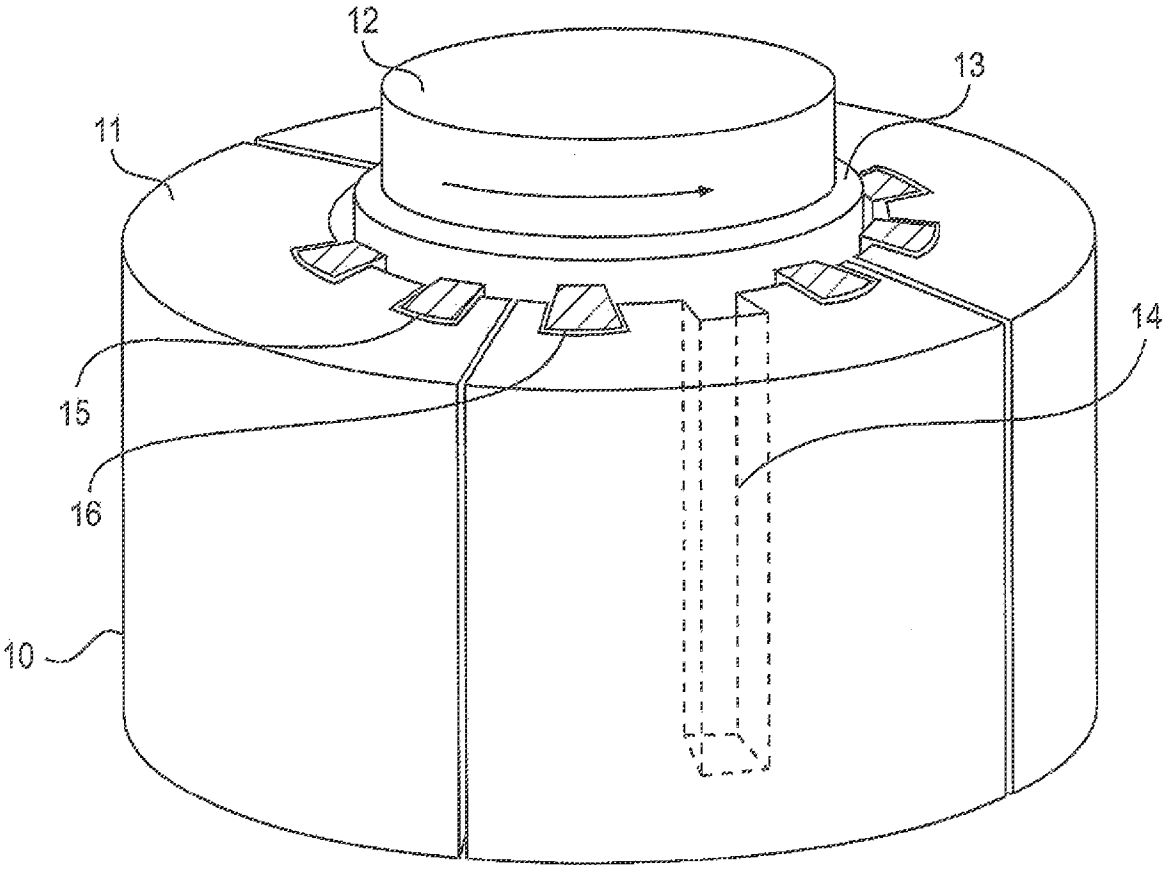
FIG. 2 is a perspective view of the segmented stave bearing housing and rotating shaft shown in FIG. 1.

Referring to FIGS. 1 and 2, a conventional, segmented stave bearing system and rotating shaft are shown. A segmented stave bearing housing 10 is shown having multiple sections 11 that surround a rotating shaft 12 that has a bearing sleeve 13. The housing 10, and specifically each segment 11, has multiple bar-shaped and substantially trapezoidal cross-section stave bearing cavities 14 into which stave bearing inserts 15 are installed. The bearing surfaces 16 of the bearing inserts 15 touch or bear upon the rotating shaft sleeve 13 and hold it and the rotating shaft 12 in a fixed position against lateral movement. As seen in FIGS. 1 and 2, the bearing housing 10 includes twelve stave bearing inserts 15. Of course there could be more or fewer stave bearing inserts that may be used in a stave bearing housing depending on the requirements of a given rotating shaft system.

Figure 3:
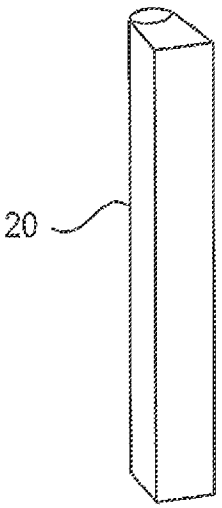
FIG. 3 is a perspective view of one example of a hone insert.
Figure 4:
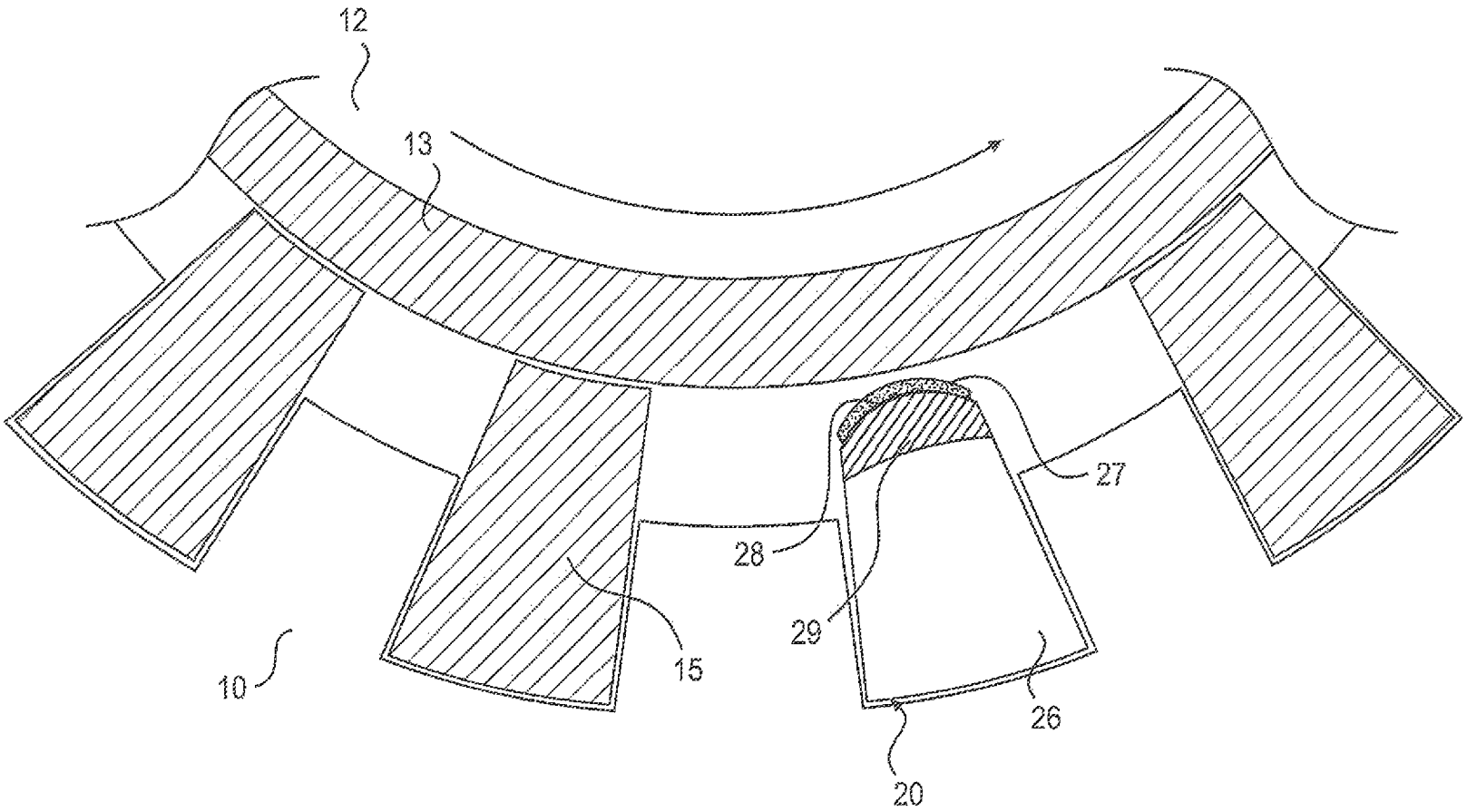
FIG. 4 is a partial top view of a segmented stave bearing housing having stave bearings and the hone insert of FIG. 3 mounted therein.
Figure 5:
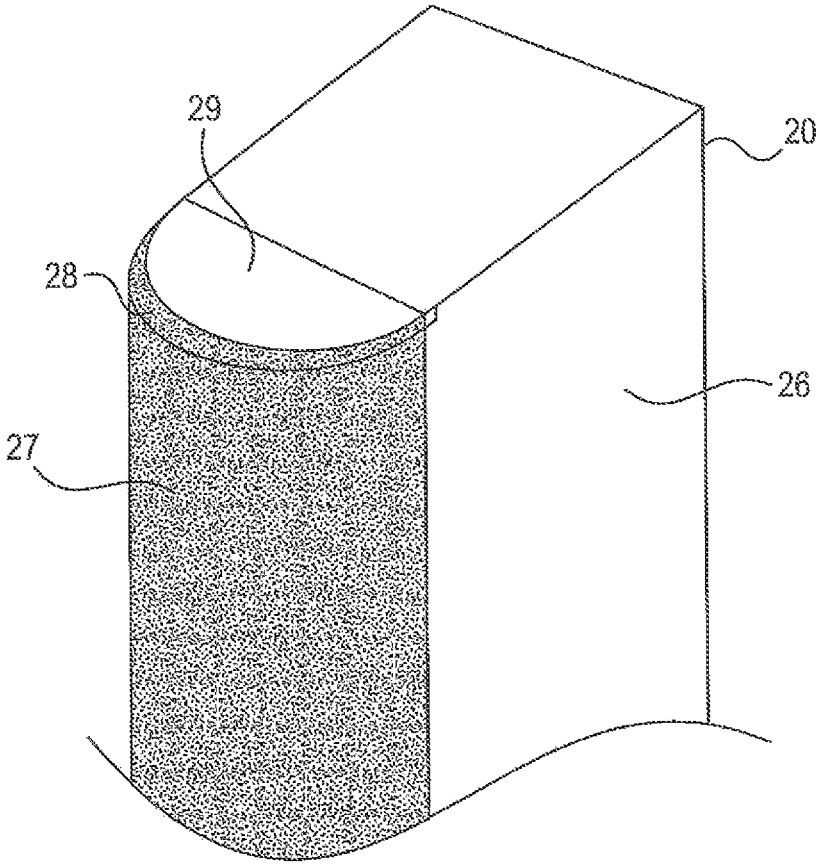
FIG. 5 is another perspective view of a portion of the hone insert of FIG. 3.

Referring to FIGS. 3-5, an example of a hone insert 20 for smoothing shafts consists of a mounting bar section 26 having a substantially trapezoidal cross-section that corresponds to the trapezoidal cross-section of the stave bearing cavity 14. In one example, the mounting bar section is constructed of a stiff durable material such as Teflon or another rigid material that is shaped to fit snuggly in one of the cavities 14 that is normally otherwise occupied by a conventional bearing insert 15. The hone insert 20 includes a honing layer 27 having an abrasive material attached with an adhesive 28 to the surface of the support pad 29 capable of contact with the worn surface of the bearing shaft sleeve 13.

The mounting bar section 26 of the hone insert 20 is shown as being a separate component than the support pad 29 which is shown as being a separate component from the honing layer 27. It is possible that the mounting bar section and support pad may be a single material. It is possible that the mounting bar section, support pad and honing layer may be a single and consistent material. It is believed that the mounting bar section being made of a rigid material allows for more efficient installation of the hone insert during the smoothing process.

The support pad 29 may be formed of a flexible foam material including, for instance, a durable polyurethane foam. Alternatively, the support pad 29 may be formed of a hollow bladder. The bladder may be expanded pneumatically by adding air or hydraulically by adding a liquid in the bladder. The bladder is configured along the longitudinal length of the support pad. By varying the inflation of the support pad, it is possible to adjust the pressure which the abrasive surface may be pressed against the bearing or bearing sleeve surface. The bladder example of the support pad may be made from a rubber material or any other flexible material that allows for expansion of that support pad. As noted earlier, both the mounting bar section and the support pad may together include a bladder therein that would allow the hone insert to be inflated or hydraulically filled once it was inserted into a stave bearing cavity.

In the example of a support pad defining a bladder therein, it is thereby possible to adjust the pressure of the abrasive material against the shaft. This pressure may range from 0.1 to 100 lbs./in.$^2$ or alternatively 1 to 50 lbs./in.$^2$ or still further alternatively 2 to 15 lbs./in.$^2$.

The linear length which the abrasive honing layer is contacting the surface of the sleeve or shaft may be varied depending on the shape of the support pad that bears the abrasive surface onto the sleeve or shaft surface. In one example, the abrasive layer may press against the shaft on a linear length of the circumference of the shaft of 0.1 to 4 inches, or alternatively, 0.5 to 2 inches, or still further alternatively about 1 to 1.5 inches.

The specific abrasive material that may be used on the hone layer of the hone insert includes any material that may be used to smooth the surface of the shaft or shaft sleeve. Generally speaking, the abrasive material may include hard materials such as aluminum oxide, diamond, garnet, carbide or other known materials. Alternatively, the abrasive material may be polymer based including, for example, using a Scotchbrite polymer. Still further alternatively, a metal fiber or particle material including steel wool or steel fibers may be used. Still further alternatively, a foam material impregnated with hard materials such as the particles described earlier herein may be used.

The abrasive material may be attached to the surface of the support pad by glue or rubber cement or other material that may be alternatively impregnated into the support pad.

The abrasive surface may have course or medium or fine levels of smoothing. It is envisioned that multiple hone inserts may be used including a course insert, a medium insert, and a fine insert used to smooth a surface. In one example, a course insert may have an abrasive in the amount of 40 to 100 grit, or alternatively about 60 to 90, or further alternatively about 70 to 80. A medium hone may include grit in the range of 80 to 220, or alternatively 100 to 200, or still further alternatively 120 to 180. A fine abrasive insert may include grit in the range of 200 to 2,000, or alternatively 200 to 600, or further alternatively 200 to 400. It is apparent that additional hone inserts may be employed. Different amounts of grit can be used with the different inserts.

Once a hone insert is installed in the stave bearing housing and around the shaft, the amount of time that the shaft is rotated and, accordingly, smoothed by the honing surface, will depend on the time and the speed of rotating of the shaft in combination with the aggressiveness of the abrasive surface and the condition of the surface being smoothed. In some examples, the shaft may be rotated while bearing against the hone insert for one minute to 24 hours, or alternatively ten minutes to eight hours, or still further alternatively about one to six hours.

In one example, a segment of a stave bearing housing is removed from the housing to expose the staves. One of the existing stave bearing inserts is removed from the trapezoidal cavity in the bearing housing. Then, a honing insert is placed into the vacant bearing segment cavity. That hone insert is then shimmed or otherwise made tight within the stave bearing cavity. The segment of the stave bearing housing is then replaced in the housing so that the abrasive surface of the hone insert is adjacent and bears down against the sleeve surface. The shaft is then rotated until smooth depending on the adhesive. These steps may then be repeated multiple times to improve the smoothness of the surface.

Figure 6B:
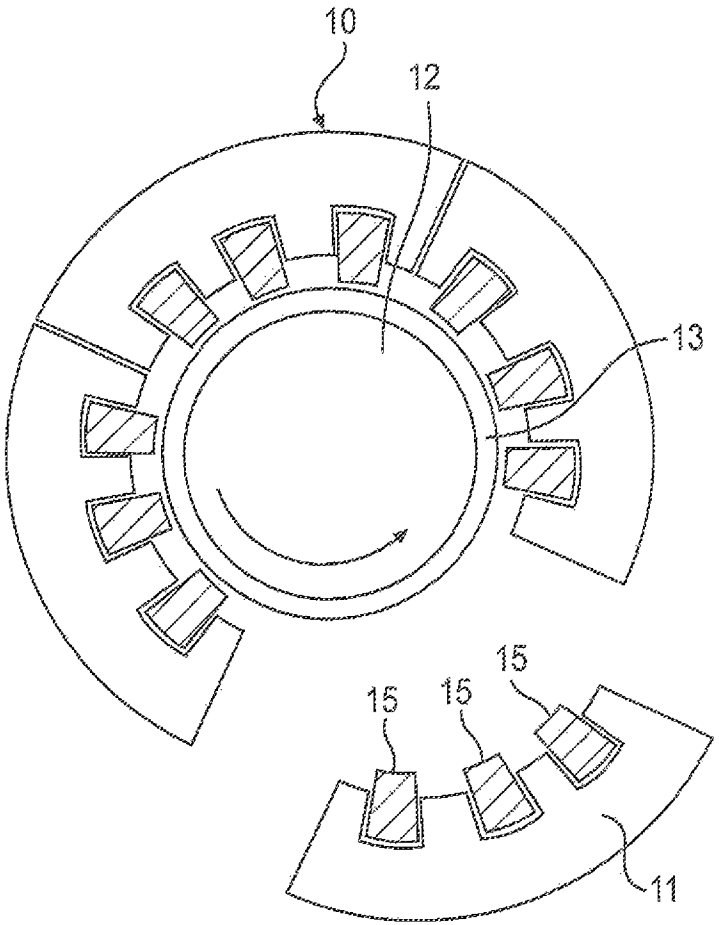
FIGS. 6A-6E are a series of top views of the segmented stave bearing of FIG. 1 and the process of substitution of the hone insert of FIG. 3 into that stave bearing.
Figure 6A:
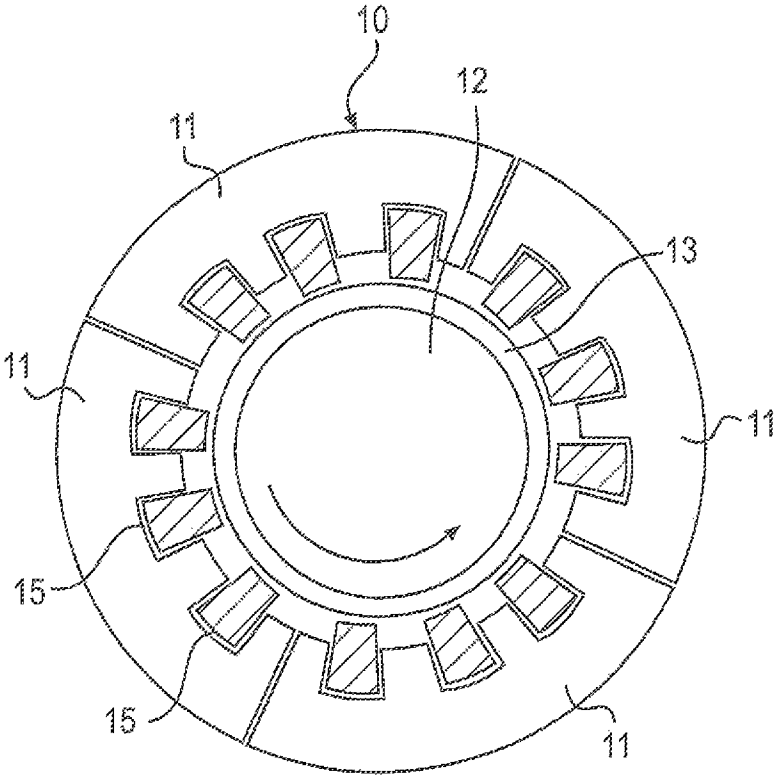

FIGS. 6A-6E illustrate the step-by-step process by which a stave bearing insert is removed from and substituted with a hone insert in accordance with an example of the present invention. FIG. 6A is similar in most respects to FIG. 1. The segmented stave bearing housing 10 includes four stave bearing segments 11. Stave bearings 15 are mounted within the segments 11 and around the center shaft 12 which has a shaft sleeve 13.

Figure 6D:
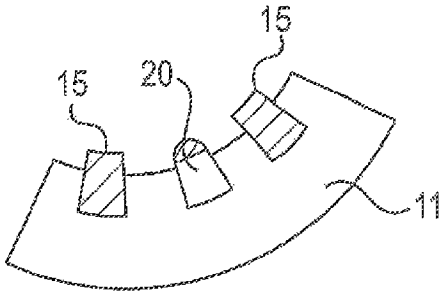
Figure 6E:
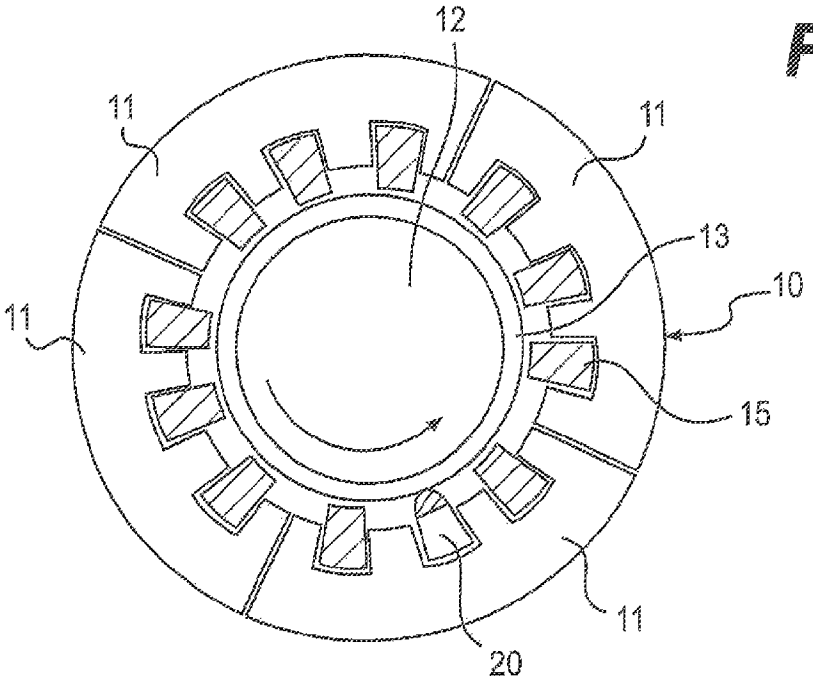
Figure 6C:
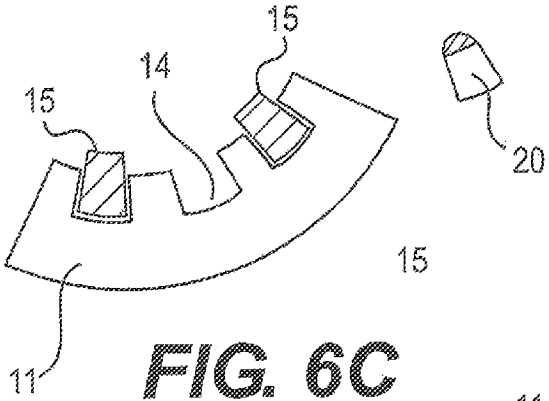

In FIG. 6B, a segment 11 of the segmented stave bearing housing 10 is removed from around the rotating shaft 12. This makes the stave bearings 15 accessible for work. Turning now to FIG. 6C, one of the stave bearing inserts 15 is removed to expose a stave bearing cavity 14. Inserted into that stave bearing cavity 14 will be the hone insert 20. FIG. 6D shows the hone insert 20 substituted into the stave bearing segment 11. Finally, FIG. 6E shows the hone insert 20 as it is brought in contact with the rotating shaft 12 and its sleeve 13 when placed back around that shaft 12.

As explained earlier, FIGS. 6A-6E describe the substitution of a single hone insert 20. It is envisioned that two or more hone inserts could be substituted around a rotating shaft like rotating shaft 12 and its sleeve 13.

Figure 7:
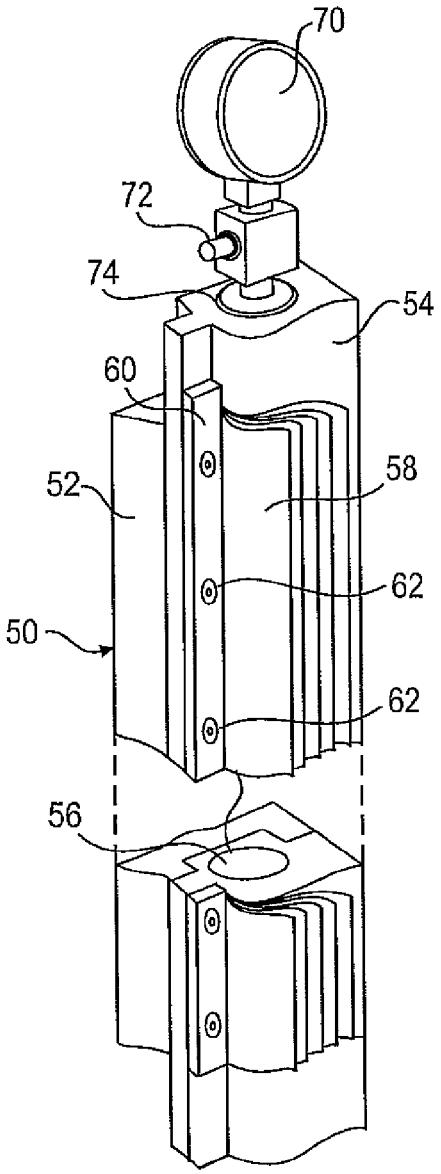
FIG. 7 is a perspective view of a second example of a hone insert.
Figure 8:
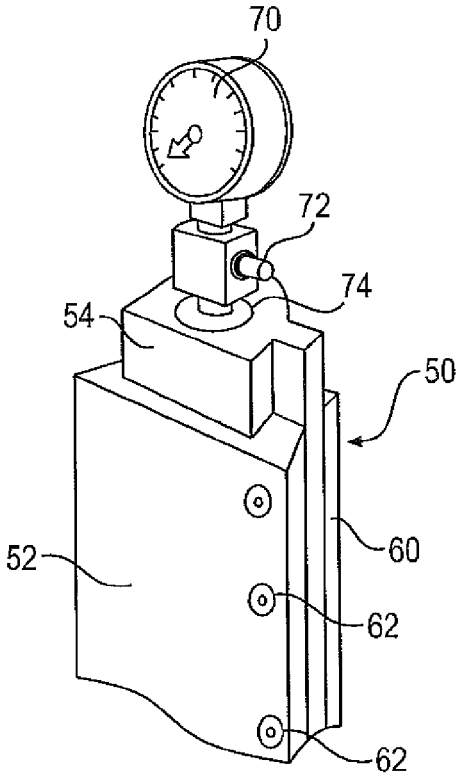
FIG. 8 is an alternative perspective view of the top portion of the hone insert shown in FIG. 7.
Figure 9:
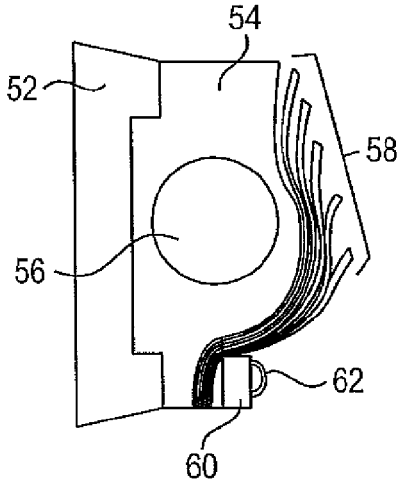
FIG. 9 is a top, cross-sectional view of the hone insert shown in FIG. 7.

Next, FIGS. 7, 8 and 9 illustrate perspective and cross-sectional views of a second example of a hone insert. The hone insert 50 includes a mounting bar section 52 which is adapted to be received into a stave bearing cavity (not shown). Attached to the mounting bar section 52 is the support pad 54. The support pad 54 is attached to the longitudinal bearing side of the mounting bar section 52. The support pad 54 is formed of a flexible elastomer material such as rubber. Inside the support pad 54 is a hollow bladder section 56. Abrasive sheets 58 (or other abrasive materials) are shown clamped to the support pad 54 using a clamp 60 and tightening screws 62. As shown, the abrasive sheets 58 are multiple sheets of abrasive-coated paper. The abrasive sheets 58 may all have the same texture or grit, or alternatively, they may be of increasing fineness so that as they wear away, the more fine grit is exposed to a rotating shaft and sleeve. It is noted that this hone insert 50 is shown in FIG. 7 for use with a shaft that rotates in the clockwise direction, as opposed to the counterclockwise direction shown in other figures. The hone insert described in several examples herein may be engineered to be used in connection with a shaft that rotates in either direction. Mounted at the top of the hollow bladder 56 is an air gauge 70 and a valve 72. The gauge 70 and valve 72 plug the top 74 of the bladder 56 to make it a sealed cavity. The valve 72 may then be used to inflate, in this example, air in the tube so that the bladder 56 may be inflated to bear the abrasive sheets 58 against a rotating shaft. In this way, the gauge 70 may be used to control or vary the pressure of the abrasive sheets 58 in bearing against a rotating shaft.

Figure 10:
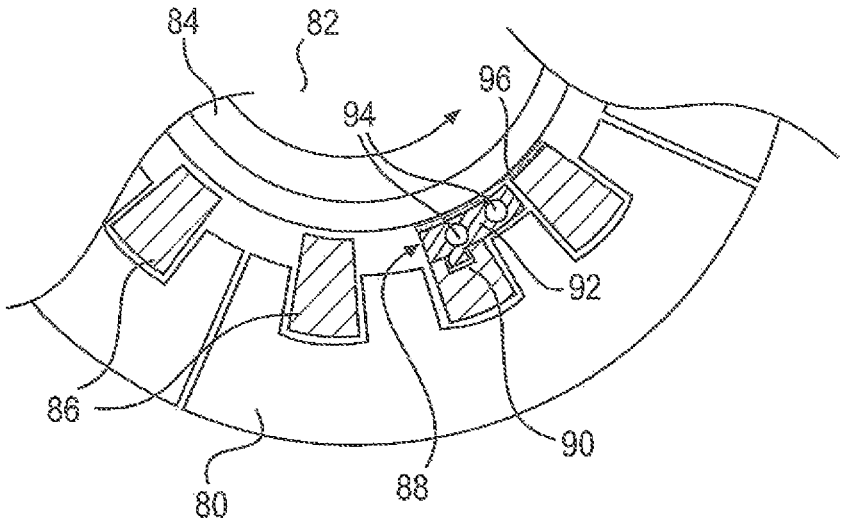
FIG. 10 is a top view of a third example of a hone insert.

FIG. 10 shows a segment 80 from a segmented stave bearing housing. FIG. 10 also shows a third example of a hone insert 88. The stave bearing segment 80 includes stave bearings 86 mounted around the rotating shaft 82 having a sleeve 84. The hone insert 88 includes a mounting bar section 90 onto which is attached a support pad 92. In this support pad 92, there are two bladder sections 94 inside the longitudinal length of the support pad 92. An abrasive hone layer 96 is attached to the side of the support pad 92 opposite the mounting bar section 90 and is shown to be adjacent to and bearing against the rotating shaft 82 and its sleeve 84.

Figure 11:
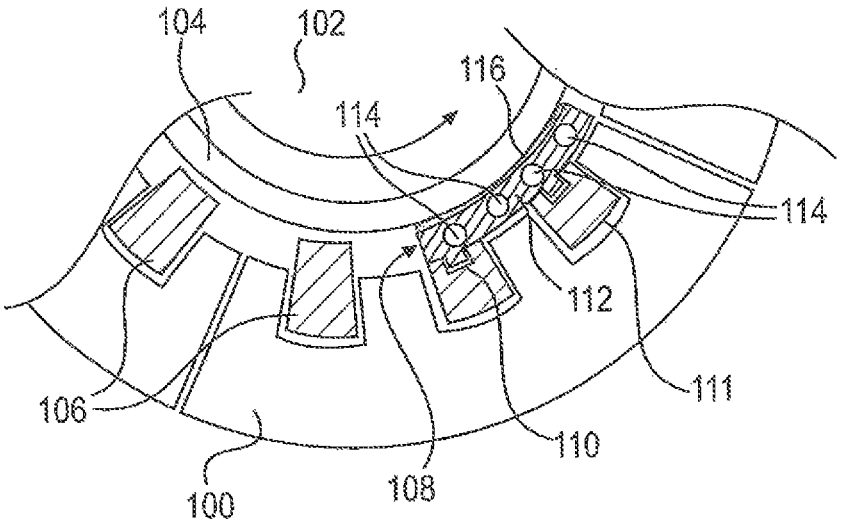
FIG. 11 is a top view of a fourth example of a hone insert.

FIG. 11 shows another stave bearing insert 100 having bearings 106 therein. The bearing inserts 106 support the rotating shaft 102 that has a shaft sleeve 104. A fourth example of a hone insert 108 is shown. The hone insert 108 includes a mounting bar section 110 having a support pad 112 having hollow bladder sections 114. The abrasive hone layer 116 is shown bearing against the sleeve 104. It is noted that the hone insert 108 is wider or, stated alternatively, has a greater circumferential contact with the rotating shaft sleeve 104 as it stretches across two mounting bar sections 110 and 111.

Other embodiments of the present invention will be apparent to those skilled in the art from consideration of the specification. It is intended that the specification and Figures be considered as exemplary only, with a true scope and spirit of the invention being indicated by the following claims.

That which is claimed is:

1. A hone insert adapted for use in a rotating shaft system having a segmented stave bearing housing comprised of a plurality of stave bearing inserts to retain the rotating shaft, the hone insert comprising:

a mounting bar section adapted to be removably fit into a stave bearing cavity in a segmented stave bearing housing, the mounting bar section having a longitudinal bearing side adapted to face a rotating shaft mounted in the stave bearing housing;

wherein the mounting bar section is comprised of a rigid material;

a support pad attached to the longitudinal bearing side of the mounting bar section;

wherein the support pad comprises a hone layer on the side of the support pad opposite the mounting bar section and adapted to be adjacent the rotating shaft when mounted in the stave bearing housing; and wherein the hone layer comprises an abrasive material on the face thereof adapted to bear against the surface of the rotating shaft, and wherein the support pad is comprised of a flexible foam material.

2. A hone insert adapted for use in a rotating shaft system having a segmented stave bearing housing comprised of a plurality of stave bearing inserts to retain the rotating shaft, the hone insert comprising:

a mounting bar section adapted to be removably fit into a stave bearing cavity in a segmented stave bearing housing, the mounting bar section having a longitudinal bearing side adapted to face a rotating shaft mounted in the stave bearing housing;

wherein the mounting bar section is comprised of a rigid material;

a support pad attached to the longitudinal bearing side of the mounting bar section;

wherein the support pad comprises a hone layer on the side of the support pad opposite the mounting bar section and adapted to be adjacent the rotating shaft when mounted in the stave bearing housing; and wherein the hone layer comprises an abrasive material on the face thereof adapted to bear against the surface of the rotating shaft, and wherein the support pad comprises a bladder therein along the longitudinal length of the support pad.

3. A hone insert as described in claim 2, wherein the bladder is adapted to be inflated pneumatically with air.

4. A hone insert as described in claim 2, wherein the bladder is adapted to be inflated hydraulically with a liquid.

5. A hone insert adapted for use in a rotating shaft system having a segmented stave bearing housing comprised of a plurality of stave bearing inserts to retain the rotating shaft, the hone insert comprising:

a mounting bar section adapted to be removably fit into a stave bearing cavity in a segmented stave bearing housing, the mounting bar section having a longitudinal bearing side adapted to face a rotating shaft mounted in the stave bearing housing;

wherein the mounting bar section is comprised of a rigid material;

a support pad attached to the longitudinal bearing side of the mounting bar section;

wherein the support pad comprises a hone layer on the side of the support pad opposite the mounting bar section and adapted to be adjacent the rotating shaft when mounted in the stave bearing housing; and wherein the hone layer comprises an abrasive material on the face thereof adapted to bear against the surface of the rotating shaft, and wherein the support pad is releasably attached to the mounting bar section.

6. A method of smoothing an outside surface of a rotating shaft in a rotating shaft system having a segmented stave bearing housing comprised of a plurality of stave bearing inserts to retain the rotating shaft, the method comprising the steps of:

providing a hone insert comprising a mounting bar section adapted to be removably fit in a stave bearing cavity in a segmented stave bearing housing, the mounting bar section having a longitudinal bearing side adapted to face a rotating shaft mounted in the stave bearing housing;

wherein the mounting bar section is comprised of a rigid material;

a support pad attached to the longitudinal bearing side of the mounting bar section;

wherein the support pad comprises a hone layer on the side of the support pad opposite the mounting bar section and adapted to be adjacent the rotating shaft when mounted in the stave bearing housing;

wherein the hone layer comprises an abrasive material on the face thereof adapted to bear against the surface of the rotating shaft;

removing a stave bearing insert from the segmented stave bearing housing that has a rotating shaft therein;

installing the hone insert into the segmented stave bearing housing at the former location of the removed stave bearing insert;

wherein the hone layer is bearing against the surface of the rotating shaft; and rotating the shaft to thereby abrade and smooth the surface of the shaft.

* * * * *